US007502571B2

(12) United States Patent
Mizude et al.

(10) Patent No.: US 7,502,571 B2
(45) Date of Patent: Mar. 10, 2009

(54) SHEET TRANSPORTATION CONTROL METHOD AND IMAGE FORMING APPARATUS

(75) Inventors: Kazuhiro Mizude, Kyoto (JP); Kenji Tanaka, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 346 days.

(21) Appl. No.: 11/379,514

(22) Filed: Apr. 20, 2006

(65) Prior Publication Data

US 2006/0245769 A1 Nov. 2, 2006

(30) Foreign Application Priority Data

Apr. 27, 2005 (JP) ..... 2005-130219

(51) Int. Cl.
*G03G 15/00* (2006.01)
*B65H 7/06* (2006.01)

(52) U.S. Cl. ..... 399/21; 399/318

(58) Field of Classification Search ..... 271/258.01, 271/258.03

See application file for complete search history.

(56) References Cited

U.S. PATENT DOCUMENTS 4,804,998 A * 2/1989 Miyawaki ..... 399/21
4,868,609 A 9/1989 Nagata et al.
5,186,449 A 2/1993 Ohmi et al.
2004/0012143 A1 * 1/2004 Yamamoto ..... 271/272

FOREIGN PATENT DOCUMENTS

| | | |
|---|---|---|
| JP | 63-288849 | 11/1988 |
| JP | 03-223033 | 10/1991 |
| JP | 07-196206 | 8/1995 |
| JP | 2002-160853 | 6/2002 |

* cited by examiner

*Primary Examiner*—Daniel J Colilla
*Assistant Examiner*—Allister Primo
(74) *Attorney, Agent, or Firm*—Renner, Otto, Boisselle & Sklar, LLP

(57) ABSTRACT

A sheet transportation control method and an image forming apparatus are provided with which it is possible to prevent, by changing a set time, frequent detection of abnormal transportation.

In an image forming apparatus 10 in which a paper jam (abnormal transportation) is detected based on the timing of detection of a sheet on which an image will be formed by each one of sheet sensors disposed along a transportation path along which said sheet is transported and based on a jam detection time (set time) stored in advance within a flash memory (storage part) 26 and paper transportation and image formation is stopped upon detection of a paper jam, when it is determined to change the jam detection time, a post-change jam detection time is determined and the jam detection time stored in the flash memory 26 is changed to thus determined jam detection time.

21 Claims, 6 Drawing Sheets

SHEET TRANSPORTATION CONTROL METHOD AND IMAGE FORMING APPARATUS

CROSS-REFERENCE OF RELATED APPLICATION

This nonprovisional application claims priority under 35 U.S.C. §119(a) on Patent Application No. 2005-130219 in Japan on Apr. 27, 2005, the entire contents of which are hereby incorporated by reference.

BACKGROUND OF THE INVENTION

The present invention relates to a sheet transportation control method according to which abnormal sheet transportation is detected based on the timing at which each one of sheet sensors disposed along a transportation path for transporting a sheet detects the sheet and based on a set time determined in advance, and upon detection of abnormal transportation, transportation of the sheet is stopped, and also to an image forming apparatus which controls, by such a sheet transportation control method, transportation of a sheet on which an image will be formed.

In an image forming apparatus such as a printer and a multi-function machine which prints (forms an image) on a paper (sheet), a jam (abnormal transportation) is detected based on intervals at which plural paper sensors disposed along a paper transportation path detect and based on a preset jam detection time (set time) determined in advance, and upon detection of a jam, the image forming apparatus stops operating, indicates the occurrence of the jam on a display panel or the like, and encourages a user to remove a jammed paper (See Japanese Patent Application Laid-Open No. 2002-160853 for instance.).

In these image forming apparatuses, multiple paper sensors are disposed at fixed locations which may be near a paper feeder roller, a registration roller and the like for example, a jam detection time, which is based on the inter-sensor distances, the paper transportation speed and chattering of the paper sensors, is calculated at the stage of designing or otherwise appropriate timing, and the calculated jam detection time is stored in a ROM (Read Only Memory) or the like in advance.

The jam detection time is set somewhat longer considering varying of the inter-sensor distances attributable to varied angles at which the paper sensors are disposed or uneven assembling of the transportation path, variations of the paper transportation speed caused by a varying paper feed/drive source, variations of a detection delay time due to differences between the individual paper sensors, etc., so as to obviate frequent jam detection.

However, as printing has become faster (from 40 sheets/second to 120 sheets/second for instance) over the recent years, in order to minimize the intervals of feeding papers (from 100 mm to 15 mm for example), it is difficult to set the jam detection time somewhat longer. High-speed printing therefore leads to a problem of frequent paper jam detection. Such rampant paper jam detection often includes erroneous detection by the paper sensors due to the varying paper transportation speed, etc. Frequent paper jam detection causes another problem that it is not possible to print at a high speed.

BRIEF SUMMARY OF THE INVENTION

The present invention has been made in light of the circumstance described above, and accordingly, an object of the present invention is to provide a sheet transportation control method and an image forming apparatus with which it is possible, by determining a new set time and changing an initial set time to thus determined new set time, to change the set time when detection of abnormal transportation is frequent and accordingly prevent frequent detection of abnormal transportation.

A further object of the present invention is to provide a sheet transportation control method and an image forming apparatus with which it is possible, by transporting a sheet at a predetermined speed and determining a new set time based on the timing at which each sheet sensor detects the sheet during this, to detect abnormal transportation with reference to a set time which considers differences between individual apparatuses.

Other object of the present invention is to provide a sheet transportation control method and an image forming apparatus with which it is possible, by transporting a sheet at a predetermined speed from a sheet feeder part which feeds sheets to a sheet output part which discharges sheets via an image forming part which forms images on sheets, to change the set time corresponding to transportation of a sheet from the sheet feeder part to the image forming part and that corresponding to transportation of a sheet from the image forming part to the sheet output part.

Another object of the present invention is to provide a sheet transportation control method and an image forming apparatus with which it is possible, by determining to change the set time upon receipt of an instruction to change the set time, to change the set time in accordance with the instruction even despite a change of the sheet transportation speed, the characteristics of the sheet sensors or the like with elapsed time.

Yet another object of the present invention is to provide a sheet transportation control method and an image forming apparatus with which it is possible, by determining to change the set time at predetermined intervals, to prevent frequent abnormal transportation detection.

Still other object of the present invention is to provide a sheet transportation control method and an image forming apparatus with which it is possible, by determining to change the set time when the number of times abnormal sheet transportation is detected reaches a predetermined count, to automatically deal with frequent abnormal transportation detection.

A further different object of the present invention is to provide a sheet transportation control method and an image forming apparatus with which it is possible, by transporting multiple types of sheets at a predetermined speed when determining the new set time, to prevent frequent detection of abnormal transportation regardless of the sheet types.

The sheet transportation control method according to the present invention is a sheet transportation control method which requires detecting abnormal sheet transportation based on the timing at which plural paper sensors disposed along a transportation path for transporting sheets each detect a sheet and based on a set time determined in advance, and upon detection of abnormal transportation, stopping transportation of the sheet, characterized in comprising the steps of: determining to change the set time; determining a post-change new set time when the change of the set time is determined, and changing the set time to thus determined new set time.

In the sheet transportation control method according to the present invention, the step of determining the new set time comprises a step of transporting the sheet at a predetermined speed and a step of determining the new set time based on the timing of sheet detection by each sheet sensor during transportation of the sheet at the predetermined speed.

In the sheet transportation control method according to the present invention, at the step of transporting the sheet at the predetermined speed, the sheet is transported at the predetermined speed from a sheet feeder part which feeds sheets to a sheet output part which discharges sheets via an image forming part which forms images on sheets.

In the sheet transportation control method according to the present invention, at the step of determining to change the set time, changing of the set time is determined upon receipt of an instruction to change the set time.

In the sheet transportation control method according to the present invention, at the step of determining to change the set time, changing of the set time is determined at predetermined time intervals.

The sheet transportation control method according to the present invention comprises a step of counting the number of times abnormal sheet transportation is detected, and at the step of determining to change the set time, changing of the set time is determined when the number of times abnormal sheet transportation is detected reaches a predetermined count.

In the sheet transportation control method according to the present invention, at the step of transporting the sheet at the predetermined speed, multiple types of sheets are transported at the predetermined speed.

The image forming apparatus according to the present invention is characterized in that it controls transportation of a sheet upon which an image is to be formed, using the sheet transportation control method according to the present invention described above.

The image forming apparatus according to the present invention is an image forming apparatus in which abnormal sheet transportation is detected based on the timing at which plural paper sensors disposed along a transportation path for transporting sheets on which images will be formed each detect a sheet and based on a set time stored in advance in a storage part, and transportation of the sheet and image formation is stopped upon detection of abnormal transportation, characterized in comprising: change determining means which determines to change the set time; set time determining means which determines a post-change new set time; and changing means which changes the set time stored in the storage part to the new set time determined by the determining means.

According to the present invention, the post-change new set time is determined and the set time decided in advance is changed to thus determined new set time, and hence, it is possible to prevent frequent detection of abnormal transportation as the set time is changed when frequent detection of abnormal transportation is expected. Prevention of frequent detection of abnormal transportation reduces interruption of processing and the work that a user removes a sheet stagnating on the transportation path, accordingly improves the convenience, and decreases a wasteful use of sheets.

According to the present invention, since a sheet is fed at a predetermined speed, and during sheet transportation at the predetermined speed, the new set time is determined based on the timing of detection of the sheet by each paper sensor, it is possible to determine the set time, not in accordance with the designed inter-sensor distances for example, but in accordance with the inter-sensor distances which are based on the actual arrangement of the sheet sensors. It is thus possible to detect abnormal transportation utilizing the set time which is based on differences between individual apparatuses, such as imbalanced sheet sensor arrangement during manufacturing and varying characteristics between the sheet sensors, instead of detecting in accordance with the set time which is determined based on the design.

According to the present invention, since a sheet is fed at the predetermined speed from the sheet feeder part which feeds sheets to the sheet output part which discharges sheets via the image forming part which forms images on sheets, it is possible to change the set time corresponding to transportation of a sheet from the sheet feeder part to the image forming part and that corresponding to transportation of a sheet from the image forming part to the sheet output part each to such a set time which is suitable considering differences between individual apparatuses.

According to the present invention, since a change of the new set time is determined upon receipt of an instruction to change the set time, when detection of abnormal transportation is frequent, a user may enter an instruction to change for instance, which makes it possible to deal with the frequent detection of abnormal transportation. Alternatively, a service person may enter an instruction to change during manufacturing or installation for instance, thereby preventing frequent detection of abnormal transportation. Even despite a change of the sheet transportation speed or the characteristics of the sheet sensors due to a change with time or an environmental change therefore, it is possible to change to a set time which corresponds to the change with time or an environmental change.

According to the present invention, since a change of the set time is determined at predetermined time intervals, it is possible to change the set time in maintenance cycles for example and prevent frequent detection of abnormal transportation. Even despite a change of the sheet transportation speed or the characteristics of the sheet sensors due to a change with time or an environmental change therefore, it is possible to change to a set time which corresponds to the change with time or an environmental change.

According to the present invention, since a change of the set time is determined when the number of times abnormal sheet transportation is detected reaches a predetermined count, it is possible to automatically deal with frequent detection of abnormal transportation. Even despite a change of the sheet transportation speed or the characteristics of the sheet sensors due to a change with time or an environmental change therefore, it is possible to change to a set time which corresponds to the change with time or an environmental change.

According to the present invention, for determination of the new set time, the new set time is determined while transporting at the predetermined speed multiple types of sheets such as normal papers, post cards and OHP (Over Head Projector) sheets, and hence, it is possible to prevent frequent detection of abnormal transportation of particular types of sheets. In the event that the timing of detection by the sheet sensors slightly changes depending upon the sheet type, the new set time may be determined for each sheet type and an average value may be calculated for instance.

According to the present invention, when detection of abnormal transportation is frequent, the set time may be changed, thereby preventing frequent detection of abnormal transportation. In addition, prevention of frequent detection of abnormal transportation improves the convenience to a user and reduces a wasteful use of sheets.

According to the present invention, it is possible to detect abnormal transportation with reference to a set time which corresponds to differences between individual apparatuses.

According to the present invention, it is possible to change a set time which corresponds to sheet transportation from the sheet feeder part to the image forming part and that corresponding to sheet transportation from the image forming part to the sheet output part.

According to the present invention, even despite a change of the sheet transportation speed or the characteristics of the sheet sensors due to a change with time or an environmental change, it is possible to change to the set time in accordance with an instruction.

According to the present invention, it is possible to prevent frequent detection of abnormal transportation.

According to the present invention, when detection of abnormal transportation is frequent, it is possible to automatically deal with the frequent detection of abnormal transportation.

According to the present invention, it is possible to prevent frequent detection of abnormal transportation of particular types of sheets.

The above and further objects and features of the invention will more fully be apparent from the following detailed description with accompanying drawings.

DETAILED DESCRIPTION OF THE INVENTION

The present invention will now be described specifically with reference to the drawings which show an embodiment of the invention.

Figure 1:
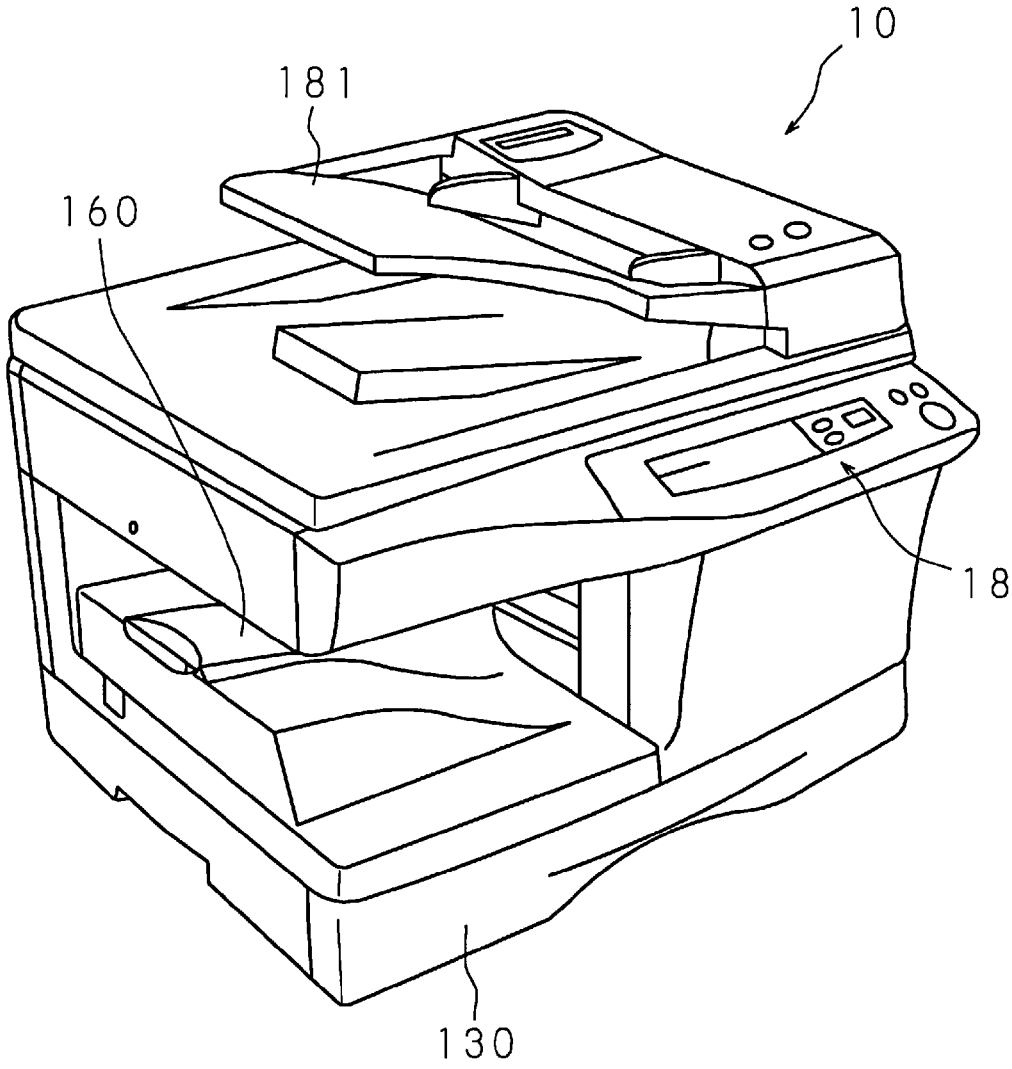
FIG. 1 is a perspective view which schematically shows the image forming apparatus according to the present invention.
Figure 2:
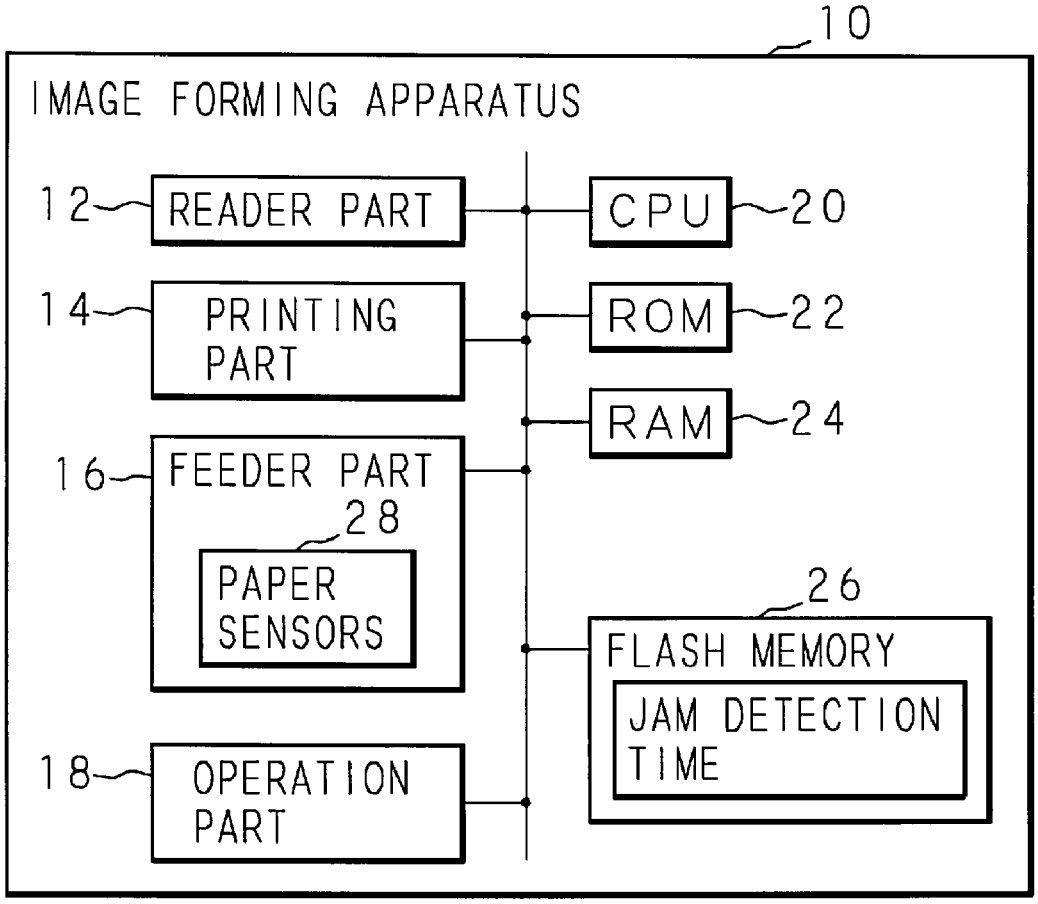
FIG. 2 is a block diagram which shows essential structures of the image forming apparatus according to the present invention.

FIG. 1 is a perspective view which schematically shows the image forming apparatus according to the present invention, and FIG. 2 is a block diagram which shows essential structures of the image forming apparatus according to the present invention. The image forming apparatus 10 comprises a reader part 12 which reads an image of an original document, a printing part 14 which forms an image on a paper (sheet), a feeder part 16 which feeds a sheet, an operation part 18 equipped with input keys, a display panel and the like, a ROM (Read Only Memory) 22 in which a control program is stored, a flash memory 26 in which various settings are stored, a CPU (Central Processing Unit) 20 which controls the respective parts (such as the reader part 12, the printing part 14 and the feeder part 16) of the apparatus based on the control program, the various setting and an operation provided through the operation part 18, and a RAM (Random Access Memory) 24 which temporarily stores data to use. The respective parts mentioned above disposed inside the image forming apparatus 10 are connected with each other via a bus so as to send and receive various types of signals.

The image forming apparatus 10 is a copier for instance, in which the printing part 14 forms on a paper an image of an original document read by the reader part 12. Where the image forming apparatus 10 is a printer for example, the reader part 12 is replaced with a communications part which receives an image (image data) from a computer, and the printing part 14 forms on a paper an image received by the communications part. Where the image forming apparatus 10 is a facsimile for instance, a communications part for data transmission with other facsimile is disposed, the printing part 14 forms on a paper an image received by the communications part, and the communications part sends an image (image data) of an original document read by the reader part 12. Alternatively, the image forming apparatus 10 may be a multi-function machine which serves as a copier, a printer and a facsimile. Where it is a multi-function machine, the operation part 18 accepts a selection of an operation mode from among a copy mode, a printer mode, a facsimile mode and the like, and the CPU 20 controls the respective parts of the apparatus in accordance with the accepted mode.

Figure 3:
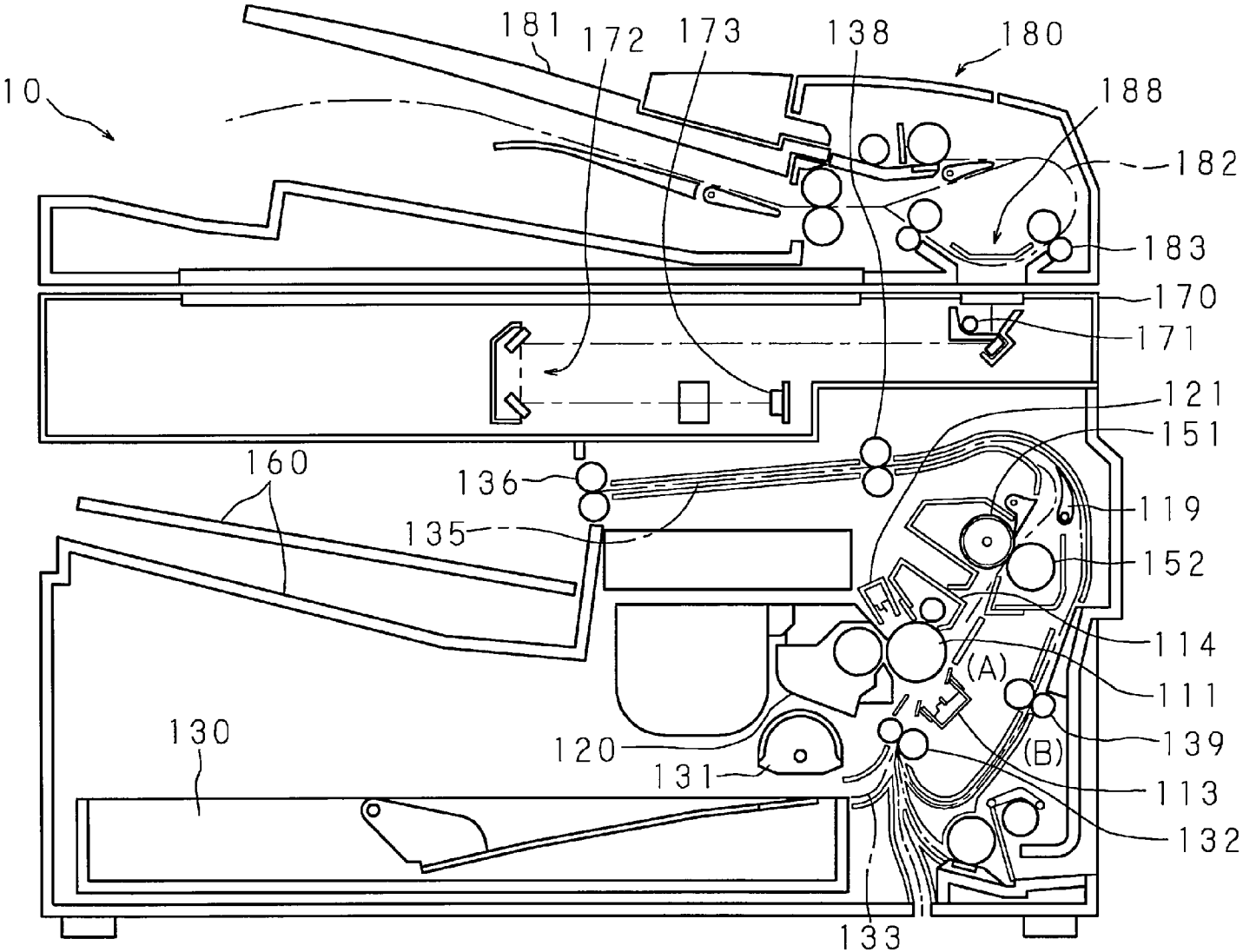
FIG. 3 is a drawing which shows detailed structures of portions which are relevant primarily to reading of an image, transportation of a paper and image formation.

FIG. 3 is a drawing which shows detailed structures of portions which are relevant primarily to reading of an image, transportation of a sheet and image formation. The image forming apparatus 10 comprises an original document handler 170 whose top surface is made of transparent glass, etc. An optical system which reads an original document is disposed below the original document handler 170. The optical system comprises, above the original document handler 170, a light source 171 which irradiates light upon an original document, an imaging lens and plural mirrors 172 which guide light to a CCD (Charge Coupled Device) 173.

Further disposed above the original document handler 170 is an original document auto-feeder apparatus 180 which automatically feeds an original document so that the original document will be read. The original document auto-feeder apparatus 180 feeds original documents one by one which are set within an original document tray 181 onto an original transportation path 182. Thus fed original document, with its front end pushed against a PS roller 183, stops temporarily. As a clutch not shown is turned on, the PS roller 183 links with a driver not shown such as a motor, which resumes transportation of the original document which has been in a temporary halt and sends the original document to an original document reader window 188.

With the light source 171 moving immediately below the original document reader window 188, light is irradiated in synchronization to the start of the transportation of the original document, whereby reflected light from the original document impinges upon the CCD 173 via various parts of the optical system. Alternatively, the light source 171 and a reflection mirror 172 may move while holding a paper on the original document handler 170. The original document auto-feeder apparatus 180, the light source 171, the reflection mirror 172, the CCD 173 and the like operate as the reader part 12 which reads an image of the original document. An image processing part not shown treats the image of the original document read by the CCD 173 through image processing, and while an LSU (Laser Scanning Unit) 121 irradiates laser light upon the surface of a photosensitive member 111, an electrostatic latent image is formed.

The photosensitive member 111 is shaped like a drum and driven into rotations by a driver not shown. Disposed around the photosensitive member 111 are the LSU 121 which irradiates laser light toward a laser irradiation point on the photosensitive member 111, a charger which charges up the surface of the photosensitive member 111 to a predetermined electric potential, a developer apparatus 120 which develops the electrostatic latent image on the surface of the photosensitive member 111 with toner into a visible image, a transfer charger 113 which transfers the toner image on the surface of the photosensitive member 111 onto a paper, and a cleaning apparatus 114 which removes residual toner staying on the surface of the photosensitive member 111. The toner image thus transferred onto the paper is fixed on the paper by a heater roller 151 and a pressure roller 152. The LSU 121, the photosensitive member 111, the developer apparatus 120, the transfer charger 113, a fixing part 150 (the heater roller 151 and the pressure roller 152) and the like operate as the printing part 14 which forms images on papers.

A paper cassette 130 houses papers. At the front end of the paper cassette 130, there is a crescent roller (paper feeder roller) 131 which sends a paper onto an input transportation path 133. Disposed along the transportation path from the paper input side to the paper output side are a separating roller not shown which separates papers fed by the crescent roller 131 into individual papers, a paper separating sensor not shown which detects that a paper moves passed the separating roller, a paper registration sensor not shown, a registration roller 132 which aligns the location of a toner image on the photosensitive member 111 to the location of a paper based on a signal received from the paper registration sensor, a fixing paper sensor not shown which senses that a paper moves passed the fixing part 150, a paper output sensor not shown which senses that a paper moves passed an output transportation path 135 and gets discharged, and a discharge roller 136 which discharges a paper. A transportation roller not shown is also disposed on the transportation path. As a paper moves passed these respective parts from the paper cassette 130 and is discharged to a paper output tray 160, a series of printing (image forming processing) completes.

Disposed between the input transportation path 133 and the output transportation path 135 are a main transportation path (A) which extends passed the photosensitive member 111 and the transfer charger 113 and an auxiliary transportation path (B) which extends parallel to the main transportation path. A guide member 119 chooses either one of the output transportation path 135—main transportation path (A) route and the output transportation path 135—auxiliary transportation path (B) route. An inversion roller 138 which changes its rotating direction under the control of the CPU 20 is disposed on the output transportation path 135, and when the inversion roller 138 rotates normally, the guide member 119 closes the output transportation path 135—auxiliary transportation path (B) route so that a paper is sent from the main transportation path (A) toward the output transportation path 135. When the inversion roller 138 rotates reversely, the guide member 119 closes the output transportation path 135—main transportation path (A) route so that a paper is sent from the output transportation path 135 toward the auxiliary transportation path (B).

A reverse feeder roller 139 is disposed on the auxiliary transportation path (B), and a paper is transported from the auxiliary transportation path (B) to the registration roller 132. As a paper is turned upside down utilizing the auxiliary transportation path (B), double-sided printing is achieved. The crescent roller 131, the input transportation path 133, the registration roller 132, the main transportation path (A), the inversion roller 138, the output transportation path 135 and the discharge roller 136 operate as the feeder part 16 which transports a paper. Meanwhile, the reverse feeder roller 139 and the auxiliary transportation path (B) operate as the feeder part 16 for double-sided printing which turns a paper upside down and transports the paper. A driver not shown such as a motor rotates the crescent roller 131, the registration roller 132, the inversion roller 138, the discharge roller 136 and the reverse feeder roller 139, and they rotate and stop rotating by means of clutches or the like not shown under the control of the CPU 20.

A copying operation of the image forming apparatus 10 will now be described. After placing a paper on the original document tray 181 or the original document handler 170, a user operates the operation part 18, thereby entering copy conditions such as a quantity and a magnification, and then enters a start instruction, which initiates the copying operation under the control of the CPU 20. The reader part 12 irradiates light from the light source 171 upon an original document fed to the original document reader window 188 or put on the original document handler 170, and reads an image of the original document with the CCD 173. Meanwhile, the feeder part 16 starts a motor of a driver not shown, whereby the crescent roller 131 rotates and unloads a paper from the paper cassette 130 and the paper arrives at the registration roller 132. Since the paper is in synchronization to the front end of the image on the photosensitive member 111, the front end of the paper is uniformly pushed against the registration roller 132 and the position of the front end is adjusted.

The image processing part not shown processes the image read by the reader part 12 (the CCD 173) under a condition designated by the operation part 18 or set in advance, and sends the image as print data to the printing part 14 (the LSU 121). A charger unit charges up the entire photosensitive member 111 to a predetermined electric potential, laser light from the LSU 121 impinges upon the photosensitive member 111 through a polygon mirror and various lenses not shown, and an electrostatic latent image is formed on the photosensitive member 111. Toner on the surface of a magnet roller disposed inside a developer tank of the developer apparatus 120 is attracted to the surface of the photosensitive member 111, and visualizes the electrostatic latent image.

Under the control of the CPU 20, the paper is conveyed toward the photosensitive member 111, which is timed by the registration roller 132, so that the transfer charger 113 transfers the toner (image) mounted on the surface of the photosensitive member 111 onto the paper. The cleaning apparatus 114 scrapes off and collects toner remaining on the surface of the photosensitive member 111. The paper now seating the transferred toner is subjected to heat and pressure by the fixing part 150 (the heater roller 151 and the pressure roller 152), and the unfixed toner on the paper melts on and fixes to the paper which will then be discharged by the discharge roller 136 to the paper output tray 160.

In the event that a copy condition calls for double-sided printing, a paper subjected to single-sided printing comes to a temporary halt after fed out to the output transportation path 135. The inversion roller 138 then rotates in the reverse direction under the control of the CPU 20, and the paper guided by the guide member 119 moves the auxiliary transportation path (B) and reaches the registration roller 132. This is followed by similar processing to that during double-sided printing described above.

The CPU 20 detects a jam (abnormal transportation) of a paper based on the timing of detection of the paper by the plural paper sensors 28 (the paper separating sensor, the paper registration sensor, the fixing paper sensor and the paper output sensor) disposed along the transportation paths (the input transportation path 133, the main transportation path (A) and the output transportation path 135) and based on a jam detection time (set time) stored in the flash memory (storage part) 26. For example, the absence of paper detection by the paper-output-side paper sensor even after the jam detection time since paper detection by the paper-input-side paper sensor is detection of a jam. Upon jam detection, the CPU 20 stops the copying operation and makes the operation part 18 shows an indication of the jam, for instance.

A jam is detected in a zone from the paper separating sensor disposed on the paper output side relative to the separating roller up to the paper registration sensor disposed on the paper input side relative to the registration roller 132 and in a zone from the fixing paper sensor disposed on the paper output side relative to the fixing part 150 up to the paper output sensor disposed on the paper input side relative to the discharge roller 136, and further in a zone from the fixing paper sensor up to the paper registration sensor for double-sided printing, for which plural jam detection times are stored in the flash memory 26. Since the processing for these is almost similar, the description below will focus on the coverage from the paper separating sensor up to the paper registration sensor as an example. In this example, no detection of a paper by the paper registration sensor even after the corresponding jam detection time since the paper separating sensor has detected the paper means detection of a jam.

In the present invention, the CPU 20 operates as the change determining means which determines a change of a jam detection time. For instance, upon receipt of an instruction to change the jam detection time (set time) through the operation part 18, the CPU 20 changes the jam detection time. As other approach, the CPU 20 may change the jam detection time at predetermined time intervals which may be maintenance cycles stored in the ROM 22. As yet another approach, the number of times that abnormal transportation is detected may be counted and stored in the flash memory 26, and the CPU 20 may change the jam detection time when a count reaches the predetermined count stored in the ROM 22.

When determining to change the jam detection time, the CPU 20 operates as set time determining means which determines a post-change new jam detection time (new set time). Controlling a feeder part 28 for instance, the CPU 20 transports a sheet at a predetermined speed, and determines a new jam detection time based on the timing at which each paper sensor 28 detects the paper during transportation of the sheet at the predetermined speed. When the jam detection time is exceeded by the detection time gap between paper detection by the paper-input-side paper sensor (the paper separating sensor) and paper detection by the paper-output-side paper sensor (the paper registration sensor) for example, a new jam detection time is determined based on this detection time gap.

At this stage, the paper transportation proceeds at a predetermined speed from the input transportation path 133 which feeds the paper to the output transportation path 135 which discharges the paper via the main transportation path (A) and the auxiliary transportation path (B) along which an image is formed on the paper. Papers transported at the predetermined speed are multiple types of standard papers such as normal papers, post cards and OHP sheets. The CPU 20 operates as changing means which stores thus determined new jam detection time in the flash memory 26 as a jam detection time.

Figure 4:
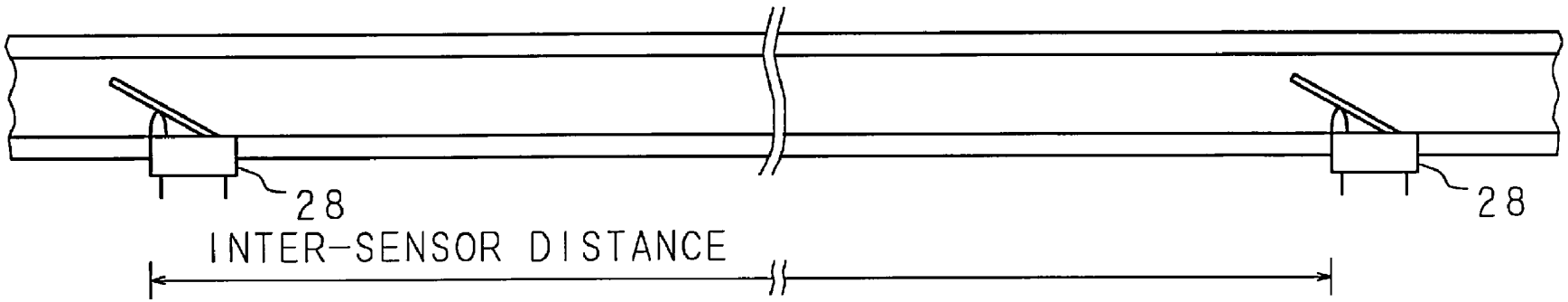
FIG. 4 is a schematic diagram of an example of the inter-sensor distances between paper sensors.
Figure 5A:
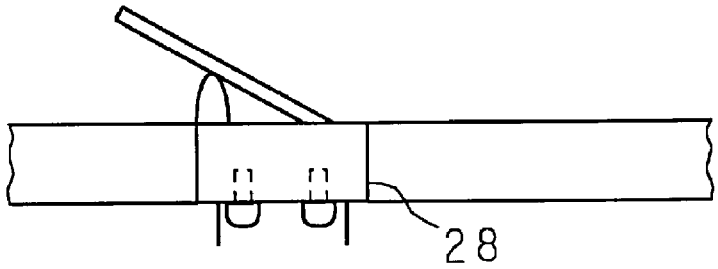
FIGS. 5A, 5B and 5C are essential enlarged views of portions where the paper sensors are disposed.
Figure 5B:
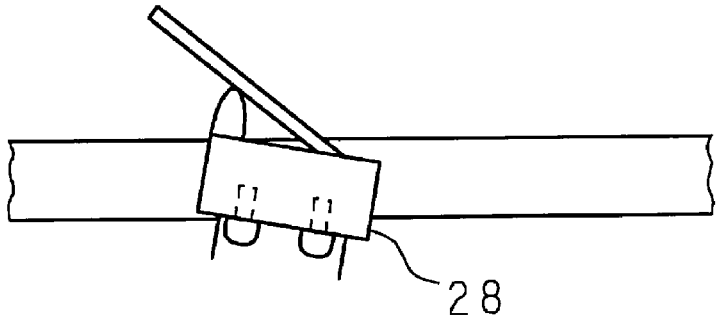
Figure 5C:
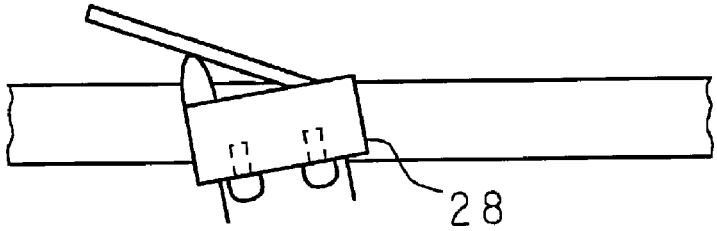

FIG. 4 is a schematic diagram of an example of the inter-sensor distances between the paper sensors. When the inter-sensor distances are 500 mm, the paper transportation speed is 150 mm/s and a detection delay time due to chattering or the like of the paper sensors 28 is 0.05 s, the detection time gap is calculated as 3.33 s so that the jam detection time is set to 3.33±0.05 s (3.38 s for instance). FIGS. 5A, 5B and 5C are essential enlarged views of portions where the paper sensors 28 are disposed. While FIG. 5A shows a state that the paper sensors 28 are arranged normally, the paper sensors 28 may not arranged normally as shown in FIGS. 5B and 5C in which case the inter-sensor distances change. Although the transportation path is curved, FIG. 4 and FIGS. 5A to 5C show it as a linear path.

When two sensors are disposed farther away from each other in an imbalanced arrangement and the inter-sensor distance is 510 mm consequently for instance, the detection time gap is expected to be 3.40 s. Meanwhile, when two sensors are disposed closer to each other in an imbalanced arrangement and the inter-sensor distance is 490 mm as a result for example, the detection time gap is predicted to be 3.27 s. The detection time gap between the two is likely to become outside the range of the jam detection time (3.33±0.05 s), which means jam detection will be frequent. In this case, during the processing of setting and changing the jam detection time, the detection time gap for transportation of a standard paper at the predetermined speed is approximately 3.40 s or 3.27 s so that the jam detection time is changed to 3.40±0.05 s (3.45 s for instance) or 3.27±0.05 s (3.32 s for example). Since the detection time gap is within the jam detection time after the change, jam detection will not occur frequently.

When an imbalanced arrangement has made one of two paper sensors located away from the other and resulted in the inter-sensor distance of 505 mm for instance, the detection time gap is expected to be 3.37 s. Meanwhile, when an imbalanced arrangement has made one of two paper sensors located closer to the other and resulted in the inter-sensor distance of 495 mm for example, the detection time gap is predicted to be 3.30 s. Since the detection time gap between the two is within the jam detection time (3.33±0.05 s), it is considered that no jam detection will occur. However, since the detection time gap does not fit in a central section of this range, jam detection will easily occur if the rollers have been worn due to a change with time, in the presence of paper powder or curling of a paper, or in a condition that the moisture content is high and slippage is likely to happen, etc. In this case, during the processing of setting and changing the jam detection time, the detection time gap for transportation of a standard paper at the predetermined speed is approximately 3.37 s or 3.30 s so that the jam detection time is changed to 3.37±0.05 s (3.42 s for instance) or 3.30±0.05 s (3.35 s for example). Since the detection time gap between the two fits in the central section of the range of the jam detection time after the change, jam detection will not occur frequently.

Figure 6:
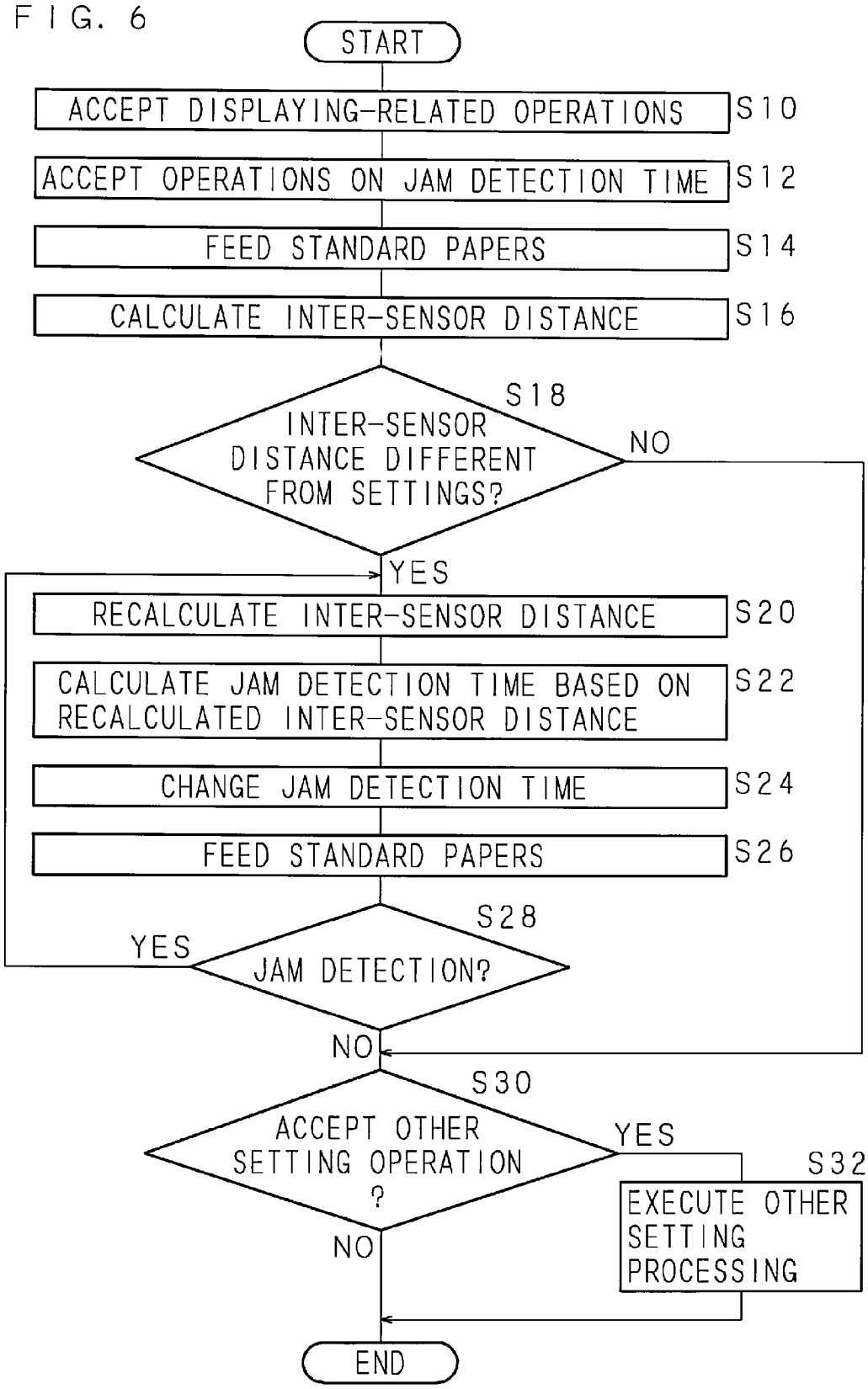
FIG. 6 is a flow chart which shows an example of procedure to change a jam detection time.

FIG. 6 is a flow chart which shows an example of procedure of setting and changing the jam detection time. Accepting displaying-related operations regarding various settings through input keys of the operation part 18 (S10), the CPU 20 displays various settings on the display panel of the operation part 18. When accepting operations to set the jam detection time (S12), the CPU 20 controls the feeder part 16 and makes multiple types of standard papers transported (S14). The multiple types of standard papers may be set within the paper cassette 130 in advance, or may be set to a hand-feed tray if any disposed. The CPU 20 calculates the detection time gap for each standard paper based on the timing of detection by the paper sensors 28, calculates the inter-sensor distances based on the detection time gap and the paper transportation speed (S16), and stores the calculated results in the RAM 24.

Where there are inter-sensor distances which are different from the inter-sensor distances (settings) stored in the flash memory 26 and corresponding to the jam detection time (S18: YES), the CPU 20 calculates an average value of those plural inter-sensor distances for instance which are different from the settings or otherwise appropriately re-calculates the inter-sensor distances (S20) and stores them in the RAM 24, calculates a jam detection time which is based on thus re-calculated inter-sensor distances (S22) and stores it in the RAM 24, stores the calculated jam detection time in the flash memory 26, and changes the jam detection time (S24).

After changing the jam detection time, the CPU 20 controls the feeder part 16 and makes multiple types of standard papers transported (S26), and upon jam detection (S28: YES), starts over again from re-calculation of the distances between the paper sensors (S20), but without any jam detection (S28:

NO) or in the absence of an inter-sensor distance which is different from the settings (S18: NO), terminates the processing of setting and changing the jam detection time, and upon receipt of other settings-related operations (S30: YES), executes other setting processing (S32), but without other settings-related operations (S30: NO), terminates the processing.

Although the embodiment described above requires transporting a standard paper only once, transportation may be provided multiple times. During transportation over multiple times, an average value of detection time gaps relevant to the respective rounds of transportation is calculated. For calculation of an average value of the plural detection time gaps, the average value may be calculated including an error which may be "average value±2σ" utilizing standard deviation σ. Alternatively, without calculating an average value of the plural detection time gaps, a mean value between a maximum value and a minimum value may be used, or the maximum or the second largest value may be used. In addition, since transportation of a paper is generally delayed as the range (T±Δ for example) of the jam detection time is set considering changes of the detection time gaps described above, variations of the sensor characteristics or the like, the maximum value (T±TΔ for example) may be set.

Further, although the inter-sensor distances are calculated in the embodiment described above (FIG. 6), when the detection time gap identified during transportation of a standard paper at the predetermined speed is different from the jam detection time which has been set in advance, a new jam detection time may be changed based on this detection time gap without calculating the inter-sensor distances. In any event, as a jam detection time is changed based on the result of actual transportation of a standard paper at the predetermined speed, such a jam detection time is set which handles varying inter-sensor distances attributable to uneven angles at which the paper sensors are disposed or uneven assembling of the transportation path, a varying paper transportation speed due to variations associated with the driver for paper transportation, a varying detection delay time owing to differences between the individual paper sensors, etc., and hence, it is possible to prevent frequent jam detection.

Although the embodiment described above requires determining a jam detection time based on a detection time gap identified during transportation of a standard paper at the predetermined speed, the jam detection time may be changed in response to an input from the operation part 18 for instance. When the jam detection time is set to 3.38 s for example, if jam detection occurs frequently, the operation part 18 may be operated to extend the jam detection time to 3.40 s and the CPU 20 may store the changed result in the flash memory 26.

When multiple types of standard papers are transported, a detection time gap regarding the paper sensors may slightly change due to the different paper qualities, and therefore, a jam detection time may be set for each type of standard papers.

As this invention may be embodied in several forms without departing from the spirit of essential characteristics thereof, the present embodiments are therefore illustrative and not restrictive, since the scope of the invention is defined by the appended claims rather than by description preceding them, and all changes that fall within metes and bounds of the claims, or equivalence of such metes and bounds thereof are therefore intended to be embraced by the claims.

The invention claimed is:

1. A sheet transportation control method in which abnormal sheet transportation is detected based on the timing of detection of a sheet by each one of plural sheet sensors disposed along a transportation path along which said sheet is transported and based on a set time determined in advance, and sheet transportation is stopped upon detection of said abnormal sheet transportation, comprising:

a step of determining a change of said set time;

in response to determining said change of said set time, a step of entering an operation mode to change said set time to a post-change new set time, said operation mode comprising:

a step of determining said post-change new set time by performing:

a step of introducing and transporting a first standard sheet at a predetermined speed;

a step of determining said post-change new set time based on the timing of detection of said first standard sheet by each sheet sensor during transportation of said first standard sheet at said predetermined speed;

a step of changing said set time to said new set time determined;

a step of confirming said new set time by introducing and transporting a second standard sheet at a predetermined speed and judging an absence of an abnormal sheet transportation based on said new set time; and a step of exiting said operation mode based upon judging said absence in said step of confirming.

2. The sheet transportation control method according to claim 1, wherein at said step of transporting said first standard sheet at said predetermined speed, said first standard sheet is transported at said predetermined speed from a sheet feeder part which feeds sheets to a sheet output part which discharges sheets via an image forming part which forms images on sheets.

3. The sheet transportation control method according to claim 1, wherein at said step of determining a change of said set time, a change of said set time is determined upon receipt of an instruction to change said set time.

4. The sheet transportation control method according to claim 1, wherein at said step of determining a change of said set time, a change of said set time is determined at predetermined time intervals.

5. The sheet transportation control method according to claim 1, further comprising:

a step of counting the number of times that said abnormal sheet transportation is detected, wherein at said step of determining a change of said set time, a change of said set time is determined when the number of times that said abnormal sheet transportation is detected reaches a predetermined count.

6. The sheet transportation control method according to claim 1, wherein at said step of transporting said first standard sheet at said predetermined speed, multiple types of sheets are transported at said predetermined speed.

7. The sheet transportation control method according to claim 2, wherein at said step of transporting said first standard sheet at said predetermined speed, multiple types of sheets are transported at said predetermined speed.

8. An image forming apparatus in which abnormal sheet transportation is detected based on the timing of detection of a sheet on which an image is to be formed by each one of plural sheet sensors disposed along a transportation path along which said sheet is transported and based on a set time stored in a storage part in advance, and sheet transportation and image formation is stopped upon detection of said abnormal sheet transportation, comprising:

change determining means for determining to change said set time;

in response to determining said change of said set time, operation means for entering an operation mode to change said set time to a post-change new set time, said operation means comprising:

set time determining means for determining said post-change new set time including:

means for introducing and transporting a first standard sheet at a predetermined speed;

means for determining said post-change new set time based on the timing of detection of said first standard sheet by each sheet sensor during transportation of said first standard sheet at said predetermined speed; and changing means for changing said set time stored in said storage part to said new set time;

confirming means for confirming said new set time by introducing and transporting a second standard sheet at a predetermined speed and judging an absence of an abnormal sheet transportation based on said new set time; and means for exiting said operation mode based upon judging said absence in said step of confirming.

9. The image forming apparatus according to claim 8, wherein said means for introducing and transporting transports said first standard sheet at said predetermined speed from a sheet feeder part which feeds sheets to a sheet output part which discharges sheets via an image forming part which forms images on sheets.

10. The image forming apparatus according to claim 8, wherein said change determining means determines a change of said set time upon receipt of an instruction to change said set time.

11. The image forming apparatus according to claim 8, wherein said change determining means determines a change of said set time at predetermined time intervals.

12. The image forming apparatus according to claim 8, further comprising:

means for counting the number of times that said abnormal sheet transportation is detected, wherein said change determining means determines a change of said set time when the number of times that said abnormal sheet transportation is detected reaches a predetermined count.

13. The image forming apparatus according to claim 8, wherein said means for introducing and transporting transports multiple types of sheets at said predetermined speed.

14. The image forming apparatus according to claim 9, wherein said means for introducing and transporting which transports said sheet at said predetermined speed transports multiple types of sheets at said predetermined speed.

15. An image forming apparatus in which abnormal sheet transportation is detected based on the timing of detection of an image on which an image is to be formed by each one of plural sheet sensors disposed along a transportation path along which said sheet is transported and based on a set time stored in a storage part in advance, and sheet transportation and image formation is stopped upon detection of said abnormal sheet transportation, comprising a controller capable of:

determining to change said set time;

in response to determining said change of said set time, entering an operation mode to change said set time to a post-change new set time, said operation mode comprising:

determining said post-change new set time by:

introducing and transporting a first standard sheet at a predetermined speed;

determining said post-change new set time based on the timing of detection of said first standard sheet by each sheet sensor during transportation of said first standard sheet at said predetermined speed;

changing said set time stored in said storage part to said new set time determined;

confirming said new set time by introducing and transporting a second standard sheet at a predetermined speed and judging an absence of an abnormal sheet transportation based on said new set time; and exiting said operation mode based upon judging said absence in said step of confirming.

16. The image forming apparatus according to claim 15, wherein in the case of transporting said first standard sheet at said predetermined speed, comprising a controller further capable of transporting said first standard sheet at said predetermined speed from a sheet feeder part which feeds sheets to a sheet output part which discharges sheets via an image forming part which forms images on sheets.

17. The image forming apparatus according to claim 15, wherein in the case of determining to change said set time, comprising a controller further capable of determining a change of said set time upon receipt of an instruction to change said set time.

18. The image forming apparatus according to claim 15, wherein in the case of determining to change said set time, comprising a controller further capable of determining a change of said set time at predetermined time intervals.

19. The image forming apparatus according to claim 15, comprising a controller further capable of:

counting the number of times that abnormal sheet transportation is detected; and in the case of determining to change said set time, determining a change of said set time when the number of times that abnormal sheet transportation is detected reaches a predetermined count.

20. The image forming apparatus according to claim 15, comprising a controller further capable of, in the case of transporting said first standard sheet at said predetermined speed, transporting multiple types of sheets at said predetermined speed.

21. The image forming apparatus according to claim 16, comprising a controller further capable of, in the case of transporting said first standard sheet at said predetermined speed, transporting multiple types of sheets at said predetermined speed.

* * * * *